United States Patent [19]

Mullen

[11] 3,933,245

[45] Jan. 20, 1976

[54] ARTICLE HOLDING AND DISPENSING CONTAINER

[76] Inventor: Patrick E. Mullen, 828 Fifth St., Apt. 9, Santa Monica, Calif. 90403

[22] Filed: July 9, 1973

[21] Appl. No.: 377,557

[52] U.S. Cl. ..... 206/498; 211/59

[51] Int. Cl.[2] ..... B65D 83/04

[58] Field of Search ..... 206/498, 232, 42; 211/57, 211/59

[56] References Cited

UNITED STATES PATENTS

| | | | |
|---|---|---|---|
| 1,524,348 | 1/1925 | Field | 211/59 |
| 1,755,927 | 4/1930 | Levinsohn | 211/59 |
| 2,126,980 | 8/1938 | Sears | 211/57 |
| 3,503,493 | 3/1970 | Nagy | 206/232 |
| 3,780,856 | 12/1973 | Braverman | 206/42 |
| 3,809,220 | 5/1974 | Arcudi | 206/498 |

FOREIGN PATENTS OR APPLICATIONS

| | | | |
|---|---|---|---|
| 577,151 | 8/1946 | United Kingdom | 206/498 |
| 939,676 | 10/1963 | United Kingdom | 211/57 |

*Primary Examiner*—William I. Price
*Assistant Examiner*—Ro E. Hart

[57] ABSTRACT

An article holding and dispensing container having an article receiving and holding compartmental tray and a plurality of vertical and horizontal score lines separating the tray into a plurality of individually removable pockets. A closure member is heat-sealed to the back of the tray closing off the pockets and includes vertical and horizontal score lines aligned with the score lines of the tray. The closure member is not heat-sealed to the tray in the vicinity of the intersection of the score lines to facilitate breaking away of individual pockets or removing the contents thereof. A plurality of such containers may be hung in a generally vertical array on support members with indicia at the top of each container and the pockets at the bottom with one of the containers being removable from the support members without the necessity of removing any of the remaining containers.

7 Claims, 6 Drawing Figures

ARTICLE HOLDING AND DISPENSING CONTAINER

BACKGROUND OF THE INVENTION

1. Field of the Invention

The present invention relates in general to article holding and dispensing containers and more particularly to a medication or pill holding and dispensing container which allows visual observation of each discrete article or pill contained therein and easily accountable sequential dispensing of individual articles or pills therefrom.

2. Description of the Prior Art

Various types of pill or article holding and dispensing containers have been made heretofore which included blister packages secured to cardboard or paper backings with appropriate tear strips or side panels for opening thereof, as in the prior U.S. Pat. Nos. 2,968,391; 3,327,843; and 3,367,491. Other containers have had plastic article holding bodies with assembled portions including separately formed slide openers or tear strip portions as in U.S. Pat. Nos. 2,255,331; 3,393,794; 3,537,422; and 2,780,349. Various other holders or packages for holding and dispensing individual articles or pills are disclosed in the prior U.S. Pat. Nos. 2,324,228; 2,411,471; 2,921,672; 3,203,541; and 3,302,775.

It is believed that the containers of the aforementioned prior patents are not fully satisfactory in that many require fabrication from individually molded plastic parts which must be assembled in an expensive and complicated manner, others require complicated manipulation for moving sealing tear strips and movement of a tray or holder relative to a surrounding sleeve for dispensing of an individual contained article or pill while others do not provide for a visual observation of the contained article or pill from one side of the container with an easy sequential controlled dispensing of individual articles from the other side of the container.

SUMMARY OF THE INVENTION

It is a primary object of the present invention to disclose and provide a container for receiving and maintaining individual articles or medication, such as pills, in a controlled accountable condition within a compartmented tray which is easily manufactured and operated for dispensing individual items therefrom when desired in a sequential known manner from one side of the container while the user can observe the contents of each compartment of the tray as well as the item being dispensed from an opposite side of the container.

It is another object of the present invention to disclose and provide a container as in the foregoing object wherein the tray is formed from a single sheet of material having compartments and view apertures therein, and closure means for closing off the compartments.

It is still another object of this invention to provide an article holding and dispensing container having means for facilitating either the removal of individual pockets or compartments or the removal of articles or the like from each compartment.

It is even another object of this invention to provide an article holding and dispensing container wherein a plurality of such containers may be hung in a vertical array and one of the so-hung containers may be quickly and easily removed from the array without the necessity of removing any of the remaining containers from the array.

These and other objects are preferably accomplished by providing an article holding and dispensing container having an article receiving and holding compartmental tray and a plurality of vertical and horizontal score lines separating the compartment into a plurality of individually removable pockets. A closure member is heat sealed to the back of the tray closing off the pockets and includes vertical and horizontal score lines aligned with the score lines of the tray. The closure member is not heat sealed to the tray in the vicinity of the intersection of the score lines to facilitate breaking away of individual pockets or removing the contents thereof. A plurality of such containers may be hung in a generally vertical array on support members with indicia at the top of each container and the pockets at the bottom with one of the containers being removable from the support members without the necessity of removing any of the remaining containers.

DESCRIPTION OF THE PREFERRED EMBODIMENTS

Figure 1:
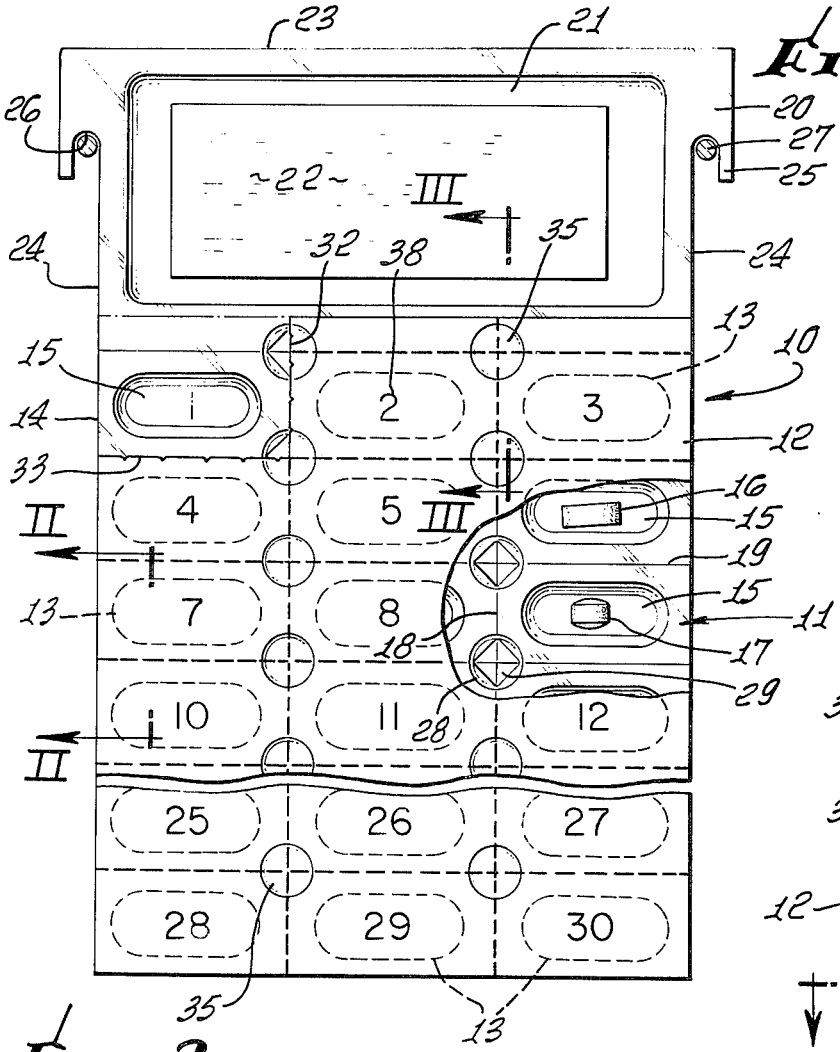
FIG. 1 is a bottom plan view of an article dispensing container in accordance with the present invention.

Referring now to FIG. 1 of the drawing, the preferred exemplary embodiment of the dispensing container is shown indicated generally at 10, and as having a compartmented portion or tray, indicated generally at 11, and a closure means, indicated generally at 12. Compartmented portion 11 may be formed from a single sheet of material which may be made from paper stock, cardboard, plastic sheet or other suitable material which can be die cut into desired shape as hereinafter explained.

Preferably, portion 11 is formed from a suitable plastic material, such as polystyrene or the like, and includes a plurality of blisters 13 in aligned rows thus forming pockets or compartments all as is well known in the packaging art. Thus, in the example shown, three aligned vertical rows having six blisters 13 in each row, are presented. The blisters are also aligned in horizontal rows forming a neat arrangement of 30 blisters 13.

Figure 2:
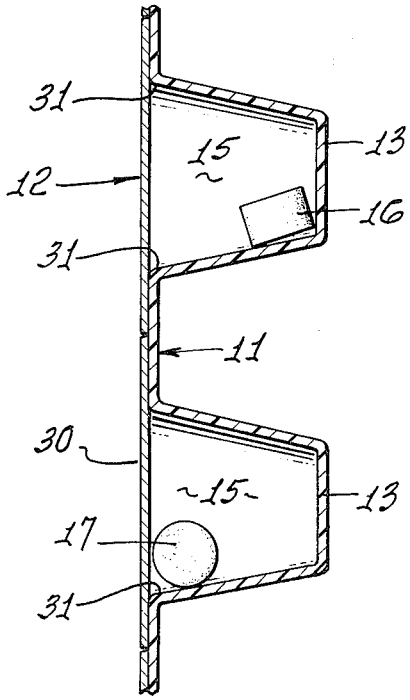
FIG. 2 is a cross-sectional view of the container of FIG. 1 taken along lines II—II thereof.

These blisters 13 occupy a first section 14 of the compartmented portion 11. As shown in FIG. 2, blisters 13 form compartments or pockets 15 for receiving individual articles, such as pills 16, 17 therein. In forming first section 14, the aligned rows of blisters 13 are scored as indicated by vertical score lines 18 and horizontal score lines 19. Thus, each blister 13 may be quickly and easily separated from an adjacent blister 13.

A second section 20 is integral with first section 14 and separable therefrom by the uppermost score line 19 on compartmented portion 11 (not visible in FIG. 1 since it is covered by closure means 12). Section 20 may include a labelling area 21 where a label 22 bearing indicia or the like thereon may be placed. Such indicia may relate to the user of the articles, such as a patient or the like, and contain pertinent medical or pill dispensing information, for example. The top edge 23 of second section 20 extends beyond the point of engagement with side edges 24 thereof, then extends downwardly to form tab members 25 on each side of section 20 having recessed portions 26 opening downwardly for receiving support members 27, such as nails or pins or the like, therein. In this manner, a plurality of containers 10 may be quickly and easily hung in a generally vertical array with indicia on label 22 being readily visible at the top, then one of the containers 10 may be quickly and easily lifted out of position without the necessity of removing any of the remaining containers from support members 27.

Figure 3:
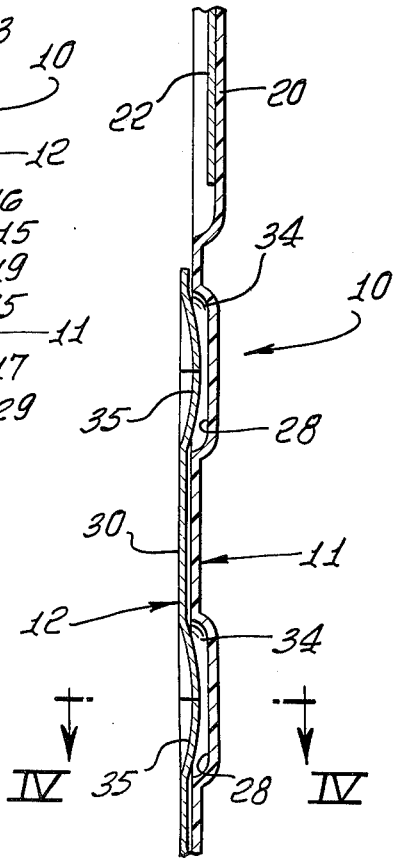
FIG. 3 is a cross-sectional view of the container of FIG. 1 taken along lines III—III thereof.

As shown in FIG. 1, the vertical and horizontal score lines 18 and 19 intersect at circular depressions 28 (see also FIG. 3) having generally centrally located generally diamondshaped raised portions 29 to facilitate in breaking away individual blisters 13. Score lines 18, 19 may intersect at the center of portions 29. The closure means, indicated generally at 12, is comprised of a single sheet 30 of material which is heat-sealed or the like to the back of first section 14 of compartmented portion 11 (i.e., closing off the open ends 31 of each blister 13 as shown in FIG. 3). Sheet 30 is divided, via perforated score lines, into individual sections configured to each blister 13. That is, each sheet 30 is comprised of a plurality of vertical score lines 32 intersecting horizontal score lines 33.

Figure 4:
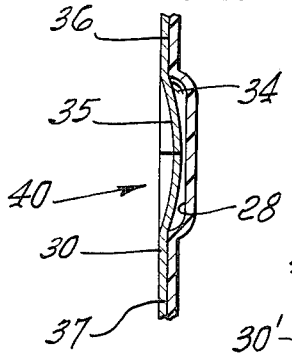
FIG. 4 is a cross-sectional view taken along the lines IV—IV of FIG. 3.

However, as particularly contemplated within the present invention, article removal facilitating means, indicated generally at 40, are provided for facilitating the removal or articles, such as pills 16, 17, from the pockets 15 of blisters 13. In the exemplary embodiment, such article removal facilitating means comprises the absence of heat-sealing in the area of each depression 28 as indicated by space 34 in FIG. 3. Sheet 30 thus includes depressed areas 35 in the vicinity of each depression 28 also as shown in FIG. 3. This is also shown in FIG. 4 where the engagement of first section 14 with sheet 30 is heat-sealed at points 36, 37 surrounding depressions 28 but not between areas 35 and depressions 28 as indicated by space 34.

Further, suitable indicia 38 is provided on each section 39 corresponding to each blister 13. The indicia 38 may be progressive numerical indicia relating to the total overall number of blisters 13, as numbers 1 through 30 in the example given. Thus, in cases where the user of the articles in container 10 must take an exact number, such as a dosage of pills or the like, the articles are packed in container 10 in such a manner that the container itself, by casual inspection, gives unequivocal evidence of the proper rate of administration. Further, the lack of heatsealing in the area of depressions 28 permits sheet 30 to be easily peeled off of each blister 13 merely by grasping sheet 30 at area 35 and the intersection of the related score lines 32 and 33 and peeling off sheet 30. However, if desired, the user may break off a desired number of blisters 13 by breaking off each blister 13 from first section 14 at the intersection of score lines 18 and 19.

Figure 5:
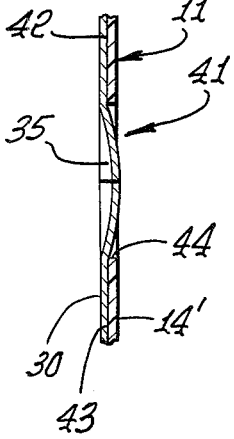
FIG. 5 is a view similar to FIG. 4 showing a first modification thereof.

A first modification of the article removed facilitating means is shown in FIG. 5. In this modification, the article removal facilitating means is indicated generally at 41. Sheet 30 is heat-sealed to section 14′ of compartmented portion 11′ at points 42 and 43. Section 14′ and portion 11′ are otherwise similar to aforementioned section 14 and portion 11. However, means 41 includes openings 44 in section 14′ at the intersection of aforementioned score lines 18, 19. These openings 44 conform to the generally circular depressions 28 of FIGS. 1 through 4. The aforementioned areas 35 of sheet 30 are of course not heat-sealed in the area of openings 44 thus facilitating in the tearing of sheet 30 from first section 14′.

Figure 6:
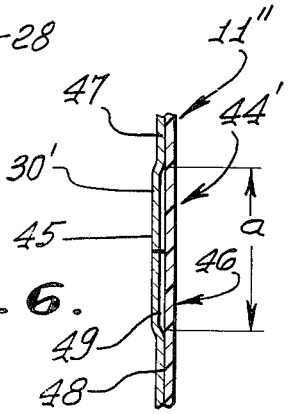
FIG. 6 is a view similar to FIG. 4 showing a second modification thereof.

Referring now to FIG. 6, a second modification of article removal facilitating means is shown indicated generally at 44′. In this embodiment, sheet 30′, otherwise similar to aforementioned sheet 30, includes a generally circular raised area 45 conforming generally to aforementioned area 35. Compartmented portion 11″, otherwise similar to aforementioned portions 11 and 11′, includes a generally flat circular area 46, having a diameter a, conforming to area 45. Sheet 30′ is heat-sealed to portion 11″ at points 47, 48 but not at the point of engagement of areas 45, 46 (thus forming space 49 therebetween). Since aforementioned score lines 32, 33 intersect in the vicinity of area 45, sheet 30′ can be quickly and easily peeled away from compartmented portion 11″.

It can be seen from the foregoing that I have described an article holding and dispensing container having improved means for facilitating removal of articles from individual pockets or compartments in the container. In addition, means are provided for quickly and easily breaking away one or more of the pockets or compartments from the remaining pockets or compartments. The container includes indicia means for indicating the number of the pockets or compartments that have been used. Finally, the container includes means for hanging a plurality of such containers in a generally vertical array permitting any one of the containers to be lifted out of the array without the necessity of removing any of the remaining containers from the array.

I claim:

1. In an article holding and dispensing container having an article receiving holding compartmental tray, a plurality of vertical frangible score lines associated with said tray separating generally aligned vertical rows of a plurality of article receiving pockets formed in said tray, pockets in said vertical rows being generally horizontally aligned with pockets in adjacent vertical rows, and horizontal frangible score lines associated with said tray separating aligned horizontal rows of said pockets, said pockets being open on one side thereof and closure means associated with said tray closing off the open sides of said pockets, the improvement which comprises:

said closure means having a plurality of vertical frangible score lines generally aligned with the vertical score lines of said holding compartment and a plurality of horizontal frangible score lines generally aligned with the horizontal score lines of said holding compartment, said closure means being heat-sealed to said holding compartment; and article removal facilitating means associated with both said holding compartment and said closure means at the intersection of said horizontal and vertical score lines, wherein said article removal facilitating means includes a plurality of non-heat-sealed zones in the areas of the intersection of the vertical and horizontal score lines of said closure means and at the intersection of the vertical and horizontal score lines of said holding compartment.

2. The improvement in the article holding and dispensing container of claim 1 wherein each of said zones are generally circular in configuration and generally of the same diameter, each of the zones of said closure means being generally aligned with each of the zones of said holding compartment at the intersection of said score lines.

3. The improvement in the article holding and dispensing container of claim 2 wherein generally diamondshaped raised portions are associated with each of the zones of said holding compartment, the horizontal and vertical score lines of said holding compartment intersecting generally at the midpoint of each of said raised portions.

4. The improvement in the article holding and dispensing container of claim 1 wherein said article removal facilitating means includes a plurality of openings in said holding compartment at the intersection of the vertical and horizontal score lines of said holding compartment.

5. The improvement in the article holding and dispensing container of claim 4 wherein said zones and said openings are generally circular and substantially of the same diameter, each of said zones in said closure means being generally aligned with each of the openings in said holding compartment.

6. The improvement in the article holding and dispensing container of claim 1 wherein said article removal facilitating means includes a plurality of raised areas in said closure means at the intersection of the vertical and horizontal score lines of said closure means said holding compartment having a plurality of generally flat portions at the intersection of the vertical and horizontal score lines thereof, and means spacing said raised areas from said flat portions.

7. The improvement in the article holding and dispensing container of claim 1 wherein said container includes an indicia receiving portion removably connected to said holding compartment by one of the horizontal score lines thereof, wherein said indicia receiving portion includes means associated therewith for hanging said container in a generally vertical position whereby said indicia receiving portion is at the top and said holding compartment is at the bottom, said means comprising tab portions integral with said indicia receiving portion extending in a direction along the top edge of said indicia receiving portion, then downwardly generally parallel on both sides of said indicia receiving portion in a manner forming a hook opening downwardly with respect to said indicia receiving portion in the direction of said holding compartment.

* * * * *